US006135454A

United States Patent [19]

Mostashari

[11] Patent Number: 6,135,454

[45] Date of Patent: Oct. 24, 2000

[54] METHOD OF PLAYING A BACCARAT GAME

[76] Inventor: Moe Mostashari, 1899 Rancho Hills Dr., Chino Hills, Calif. 91709

[21] Appl. No.: 09/260,831

[22] Filed: Mar. 2, 1999

[51] Int. Cl.[7] ..... A63F 1/00

[52] U.S. Cl. ..... 273/292; 273/306

[58] Field of Search ..... 273/292, 274, 273/309, 306

[56] References Cited

U.S. PATENT DOCUMENTS

| | | | |
|---|---|---|---|
| 5,395,119 | 3/1995 | Jacob et al. | 273/274 |
| 5,653,445 | 8/1997 | Quach | 273/292 |
| 5,901,958 | 5/1999 | Andrews | 273/292 |

OTHER PUBLICATIONS

Scarne's Encyclopedia Of Games, John Scarne, "Scarney Baccarat". Harper & Row Publishers, pp. 297–302, 1973.

"California Baccarat", Casino Concepts, Inc., 1973.

*Primary Examiner*—Benjamin H. Layno

*Attorney, Agent, or Firm*—Leonard Weiss

[57] ABSTRACT

Eight standard decks of cards are each augmented by two jokers and shuffled together. A joker has any desired point value from zero to nine. All other cards have point values similar to those encountered in Baccarat. After a player has made a wager, a player hand, comprised of two cards, is dealt to the player. A bank hand comprised of two cards is dealt to a bank represented by the dealer, one card of the two card bank hand being dealt face up and the other face down. The player has an option of being dealt an additional card when the point value of the player's two card hand is less than seven and the face up card is not a joker. The bank is dealt an additional card when the point value of the two card bank hand is less than six. The player wins by having a hand with a higher rank than the rank of the bank hand.

11 Claims, 1 Drawing Sheet

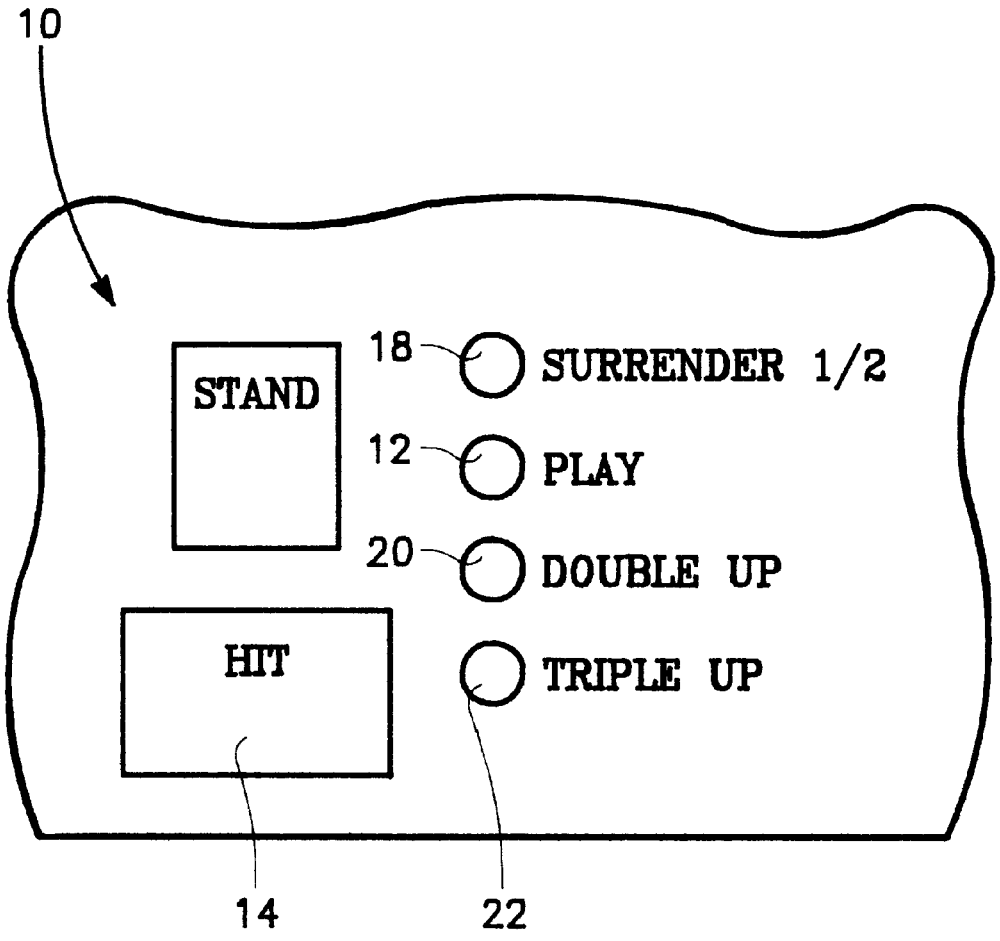
10
STAND
HIT
18
SURRENDER 1/2
12
PLAY
20
DOUBLE UP
TRIPLE UP
14
22

METHOD OF PLAYING A BACCARAT GAME

BACKGROUND OF THE INVENTION

1. Field of Invention

This invention is in the general field of casino gaming and, more particularly, is a variation of the game of Baccarat.

2. Description of the Prior Art

Baccarat is a game that is usually played in a casino, where one or more players play against a bank. In Europe, the bank is one of the players. In a typical casino in the United States, the bank is a dealer employed by the casino.

Before cards are dealt, a player makes a wager on either a player hand or a bank hand. Since the player makes the wager on either of the hands, there is an absence of a focussed adversarial relationship between the player and the dealer.

After the wager is made, two cards are dealt to form the player hand and two cards are dealt to form the bank hand. The hands are dealt from one or more standard decks of cards that are shuffled together. The rules of Baccarat provide for dealing a third card to the player hand and dealing a third card to the bank hand under certain conditions.

Whether the player hand or the bank hand is a winning hand is determined by their point values. The hand with the highest point value is the winning hand.

The point value of an exemplary hand is obtained from the sum of the point values of cards that comprise the exemplary hand. Kings, Queens and Jacks have a point value of zero. All other cards have a point value equal to their numerical face value with an ace having a point value of one.

When the sum is a single digit number, the sum is the point value of the exemplary hand. When the sum is a two digit number, the low order digit of the sum is the point value of the exemplary hand. Therefore, the highest point value of a hand is nine. A natural is a term that is used to describe a hand, comprised of two cards, that has a point value of either eight or nine.

Americans spend on the order of 1.5 billion dollars per year playing Baccarat. Accordingly, Baccarat has a large core measure of popularity. A variation of the game of Baccarat that provides the focussed adversarial relationship between the player and the dealer would have an increased popularity.

SUMMARY OF THE INVENTION

An object of the present invention to provide a focussed adversarial relationship between a player and a dealer in a game that is similar to Baccarat.

According to the present invention, in a game called $21^{ST}$ Century Baccarat, one or more standard decks of cards that are shuffled together are augmented by two or more jokers. A joker has any desired point value from zero to nine. All other cards have point values similar to point values encountered in Baccarat. The point value of a hand in $21^{ST}$ Century Baccarat is determined in a manner similar to the way it is determined in Baccarat with two jokers being a natural that has a higher rank than any other natural.

After a player has made a wager a player hand comprised of two cards is dealt to the player and a bank hand comprised of two cards is dealt to a bank represented by the dealer. The player hand is played against the bank hand. The player wins when the player hand has a point value that is higher than the point value of the bank hand.

The invention provides a game similar to Baccarat that has a competitive aspect that is unknown in Baccarat.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of markings that define one of a plurality of player stations carried atop a table where $21^{ST}$ Century Baccarat is played.

DESCRIPTION OF THE PREFERRED EMBODIMENT

In this embodiment, cards are dealt from eight standard decks of cards that are shuffled together. Each of the decks are augmented by two jokers. In one alternative embodiment, the cards are dealt from other than eight augmented decks. In another alternative embodiment, some, but not all of the decks are augmented.

Point values in $21^{ST}$ Century Baccarat are similar to those encountered in Baccarat. However, a joker has any desired point value from 0 to 9. A hand consisting of two jokers is a natural that has a higher rank than any other natural. The ranking of hands, in descending order, is given as:

two jokers (two cards only)
natural nine
natural eight*
nine
eight
seven
six
five
four
three
two
one
zero.

* The bank's three card nine has a higher rank than a player's natural eight.

$21^{ST}$ Century Baccarat is played by one or more players positioned adjacent to respective player stations atop a table. As shown in the drawing, a player station 10 is exemplary of a plurality of player stations that are atop the table. The station 10 is partially bounded by an edge 11 of the top of the table.

The player station 10 includes a circular marking 12 adjacent to lettering of the word, play. Prior to the start of play, a player at the station 10 makes an initial wager by placing cheques representative of the initial wager within the circle 12. The initial wager is against a bank as represented by a dealer. In a similar manner, players at other player stations make initial wagers.

Formation of Two Card Player Hands and a Two Card Bank Hand

After the player makes the initial wager, the dealer deals two cards to the player, whereby the player has a two card player hand. Preferably, cards comprising the two card player hand are dealt face down. In a similar manner, cards are dealt to all other players. When the player's hand is a natural, the player must expose his cards. The dealer additionally deals himself a two card bank hand, one card being dealt face up and the other face down.

The Face Up Card is a Joker

When the face up card of the two card bank hand is a joker, the game is concluded and wagers are resolved in a manner described hereinafter.

Player Options When the Face Up Card is Not a Joker

A first of five options may be exercised by the player when the point value of the player's two card hand is greater than four. More particularly, the player has an option of requiring the dealer not to deal an additional card to the player.

The player indicates to the dealer an exercise of the first option by placing the two card player hand within a rectangle 14 of the station 10. The rectangle 14 has lettering of the word, STAND, therein. In a similar manner, all other players may exercise the first option.

A second of the five options may be exercised by the player when the point value of the player's two card hand is less than seven. More particularly, the player has an option of requiring the dealer to deal an additional card to the player.

The player indicates to the dealer an exercise of the second option by placing the two card player hand within a rectangle 16 of the station 10. The rectangle 16 has lettering of the word, HIT, therein. In a similar manner, all other players may exercise the second option.

Like the second option, a third of the five options may be exercised by the player when the point value of player's two card hand is less than seven. More particularly the third option is a surrender option.

The player may choose to exercise the surrender option after evaluating the two card player hand vis-à-vis the face up card. To exercise the surrender option, the player removes the cheques from the circle 12 and places cheques representative of half of the initial wager within a circle 18 of the station 10. The dealer takes the checks from the circle 18. Hence, by exercising the surrender option, the player chooses to lose one half of the initial wager without further risk.

The circle 18 is adjacent to lettering of the phrase, SURRENDER ½. Additionally, the circle 18 is adjacent to the circle 12, with centers of the circles 12, 18 being along a line (not shown) perpendicular to the edge 11. The player has no further participation in the game after exercising the surrender option. In a similar manner, all other players may exercise the surrender option.

Like the second and third options, a fourth of the five options can only be exercised by the player when the point value of two card player hand is less than seven. More particularly, the fourth option is a double up option whereby the player places cheques representative of the amount of the initial wager within a circle 20 of the station 10 thereby doubling the player's wager. In a similar manner, all other players may double their wagers. When the bank hand is not a natural, the dealer deals one additional card face up to each of the players who double up.

The circle 20 is adjacent to lettering of the phrase, DOUBLE UP. Additionally, the circle 20 is adjacent to the circle 12, with centers of the circles 12, 18, 20 being along the line perpendicular to the edge 11.

Like the second, third and fourth options, a fifth option can only be exercised by the player when the point value of the two card player hand is less than seven. More particularly, the fifth option is a triple up option whereby the player places cheques representative of twice the amount of the initial wager within a circle 22 of the station 10 thereby tripling the player's wager. In a similar manner, all other players may triple their wagers. When the bank hand is not a natural, the dealer deals one additional card face up to each of the players who triple up.

The circle 22 is adjacent to lettering of the phrase, TRIPLE UP. Additionally, the circle 22 is adjacent to the circle 20, with centers of the circles 12, 18, 20, 22 being along the line perpendicular to the edge 11.

Formation of the Bank Hand When the Up Card is Not a Joker

When the point value of the two card bank hand is less than six, the dealer deals one additional card to form a three card bank hand.

Resolution of Wagers

When the player's hand and the bank hand are of equal rank, the result is what is known as a push. In the event of a push, the dealer refunds the player's initial wager except when the point value of the player's hand and the bank's hand is either zero or five; when the point value is either zero or five, the player loses the initial wager. A push is resolved in a similar manner for all other players.

When the bank hand is a natural, the dealer gives a partial refund of wagers to players who have either doubled up or tripled up. The partial refund is in an amount that causes those players who have either doubled up or tripled up to have only their initial wagers at risk when the bank hand is a natural.

Whether the player wins or loses a wager is determined by comparing the rank of the player's hand to the rank of the bank hand. The player wins one to one return on the initial wager by having a hand with a higher rank than the rank of the bank hand. Conversely, when the rank of the bank hand is higher, the player loses the initial wager.

While the invention has been particularly shown and described with reference to a preferred embodiment thereof, it should be understood by those skilled in the art that changes in form and detail may be made therein without departing from the spirit and scope of the invention.

I claim:

1. The method of playing a Baccarat game wherein cards have a point value similar to those encountered in a conventional Baccarat game, comprising the steps of:

providing a standard deck of cards;

augmenting said deck with a plurality of jokers, each of said jokers having any desired point value from 0 to 9, cards from said augmented deck being dealt by a dealer who represents a bank;

a player making a wager;

dealing a hand of cards to said player and a hand of cards to said bank;

resolving said wager in favor of said player when the rank of said player's hand is higher than the rank of said bank hand, ranking of hands, in descending order, being given as:

two jokers (two cards only)
natural nine
natural eight*
nine
eight
seven
six
five
four
three
two
one
zero.

* wherein a bank's hand having three cards totaling nine has a higher rank than said player's natural eight

2. The method of claim 1 wherein said step of resolving includes the step of returning said wager to said player when the point values of said player and bank hands are equal except when said equal point values are one or more known point values, said player losing said wager when said equal point values are either of said one or more known point values.

3. The method of claim 2 wherein said known point values are zero and five.

4. In the method of claim 1, wherein said step of dealing includes dealing two cards to said player to create a two card player hand and two cards to said bank to create a two card bank hand with one card of said two card bank hand being dealt face up and the other being dealt face down, the additional steps of:

giving said player an option of being dealt an additional card when said face up card is not a joker and the point value of said two card player hand is less than a first point value; and dealing said bank an additional card when said face up card is not a joker and the point value of said two card bank hand is less than a second point value.

5. The method of claim 4 wherein said first point value is seven.

6. The method of claim 4 wherein said second point value is six.

7. The method of claim 4 including the additional step of giving said player an option of surrendering one half of the amount of said wager when the point value of said player's two card hand is less than said first point value.

8. The method of playing a Baccarat game wherein cards have a point value similar to those encountered in a conventional Baccarat game, comprising the steps of:

providing a standard deck of cards;

augmenting said deck with a plurality of jokers, each of said jokers having any desired point value from 0 to 9, cards from said augmented deck being dealt by a dealer who represents a bank;

a player making a wager;

dealing two cards to said player to create a two card player hand and two cards to said bank to create a two card bank hand with one card of said two card bank hand being dealt face up and the other being dealt face down;

giving said player an option of being dealt an additional card when said face up card is not a joker and the point value of said two card player hand is less than a first point value;

dealing said bank an additional card when said face up card is not a joker and the point value of said two card bank hand is less than a second point value;

giving said player an option of doubling said wager and being dealt an additional card when said face up card is not a joker and the point value of said two card player hand is less than said first point value;

resolving said wager in favor of said player when the rank of said player hand is higher than the rank of said bank hand, ranking of hands, in descending order, being given as:

two jokers (two cards only)
natural nine
natural eight*
nine
eight
seven
six
five
four
three
two
one
zero.

* wherein a bank's hand having three cards totaling nine has a higher rank than said player's natural eight

9. The method of claim 8 including the additional step of returning to said player one half of said doubled wager when said bank hand is a natural.

10. The method of playing a Baccarat game wherein cards have a point value similar to those encountered in a conventional Baccarat game, comprising the steps of:

providing a standard deck of cards;

augmenting said deck with a plurality of jokers, each of said jokers having any desired point value from 0 to 9, cards from said augmented deck being dealt by a dealer who represents a bank;

a player making a wager;

dealing two cards to said player to create a two card player hand and two cards to said bank to create a two card bank hand with one card of said two card bank hand being dealt face up and the other being dealt face down;

giving said player an option of being dealt an additional card when said face up card is not a joker and the point value of said two card player hand is less than a first point value; and dealing said bank an additional card when said face up card is not a joker and the point value of said two card bank hand is less than a second point value;

giving said player an option of tripling said wager and being dealt an additional card when said face up card is not a joker and the point value of said two card player hand is less than said first point value;

resolving said wager in favor of said player when the rank of said player hand is higher than the rank of said bank hand, ranking of hands, in descending order, being given as:

two jokers (two cards only)
natural nine
natural eight*
nine
eight
seven
six
five
four
three
two
one
zero.

* wherein a bank's hand having three cards totaling nine has a higher rank than said player's natural eight

11. The method of claim 10 including the additional step of returning to said player two thirds of said tripled wager when said bank hand is a natural.

* * * * *